US010711440B2

(12) United States Patent
Laskaris

(10) Patent No.: US 10,711,440 B2
(45) Date of Patent: Jul. 14, 2020

(54) AUTOMATIC FIRE HYDRANT WATER SUPPLYING SYSTEM

(71) Applicant: Hale Products, Inc., Collegeville, PA (US)

(72) Inventor: Michael A. Laskaris, Collegeville, PA (US)

(73) Assignee: Hale Products, Inc., Collegeville, PA (US)

( * ) Notice: Subject to any disclaimer, the term of this patent is extended or adjusted under 35 U.S.C. 154(b) by 0 days.

(21) Appl. No.: 16/299,785

(22) Filed: Mar. 12, 2019

(65) Prior Publication Data

US 2019/0277010 A1 Sep. 12, 2019

Related U.S. Application Data

(60) Provisional application No. 62/641,663, filed on Mar. 12, 2018.

(51) Int. Cl.

| | |
|---|---|
| ***E03B 9/02*** | (2006.01) |
| ***A62C 37/10*** | (2006.01) |
| ***A62C 37/21*** | (2006.01) |
| ***E03B 9/04*** | (2006.01) |

(52) U.S. Cl.

CPC ..... *E03B 9/027* (2013.01); *A62C 37/10* (2013.01); *A62C 37/21* (2013.01); *E03B 9/04* (2013.01)

(58) Field of Classification Search

CPC . E03B 9/027; E03B 9/04; A62C 37/21; A62C 37/10

See application file for complete search history.

(56) References Cited

U.S. PATENT DOCUMENTS

| | | | | |
|---|---|---|---|---|
| 3,974,879 | A | 8/1976 | Nelson, Jr. et al. | |
| 3,981,618 | A | 9/1976 | Nelson, Jr. | |
| 4,561,459 | A * | 12/1985 | Jackman | E03B 9/04 137/291 |
| 7,987,916 | B2 | 8/2011 | Laskaris et al. | |
| 8,616,295 | B2 | 12/2013 | Laskaris et al. | |
| 9,399,151 | B1 * | 7/2016 | Combs et al. | A62C 37/00 |
| 9,546,652 | B2 | 1/2017 | Yin | |
| 9,919,170 | B2 * | 3/2018 | Cerrano | A62C 37/00 |
| 2005/0077057 | A1 | 4/2005 | Laskaris | |
| 2013/0105010 | A1 | 5/2013 | McLoughlin | |

* cited by examiner

*Primary Examiner* — Kevin L Lee

(74) *Attorney, Agent, or Firm* — Panitch Schwarze Belisario & Nadel LLP

(57) ABSTRACT

An automatic fire hydrant water supplying system provides hydrant supply water to a fire truck having a water pump; a water pump master intake valve; a water-supply fire hose, a pressure sensor upstream of the master-intake-valve, and a water-pump control system. The automatic fire hydrant water supplying system has a remotely-controllable hydrant discharge valve connectable to the hydrant and to the fire-hose. A remotely-controllable air bleed valve is in fluid communication with the master-intake-valve and the fire-hose. The water-pump control system determines whether a pressurized volume in the fire hose upstream of the master-intake-valve input port is air or water based on a difference in density between air and water as sensed by the pressure sensor and if the pressurized volume is air causes the air to be vented to atmosphere through the air-bleed-valve before opening the master-intake-valve to provide hydrant supply water to the water pump.

8 Claims, 8 Drawing Sheets

AUTOMATIC FIRE HYDRANT WATER SUPPLYING SYSTEM

CROSS-REFERENCE TO RELATED APPLICATIONS

This application claims the benefit of U.S. Provisional Patent Application No. 62/641,633, filed Mar. 12, 2018, the disclosures of which are incorporated herein by reference.

BACKGROUND OF THE INVENTION

The present invention relates to an automatic fire hydrant water supplying system. More particularly, the present invention relates to an automatic fire hydrant water supplying system including an automatic hydrant flush valve for flushing debris from the standpipe (or barrel) of the hydrant, a remote-control hydrant supply valve for controlling the flow of water from the hydrant and an automatic air bleed valve for venting air from the fire hose supplying water to the master intake valve (MIV) of a fire truck pump and automatic refilling of the on-board water tank on the pumper fire truck.

In a typical fire scene scenario, as the pumper fire truck arrives at the fire scene, the pumper fire truck pauses at the nearest hydrant and a hydrant operator opens the hydrant to allow the initial flow of water to flush debris from the barrel and outlet of the hydrant. Thereafter, the hydrant operator attaches one end of a large-diameter, lay-flat (LDH) supply hose to the hydrant via an adapter or valve and remains at the hydrant to open the hydrant valve upon request as the pumper truck proceeds to the fire building laying out from the back of the truck the LDH supply hose.

Upon the pumper fire truck's arrival at the structure on fire, a fire truck pump operator immediately begins to pump water from the on-board water tank (or reservoir) onto the fire. As the water is being pumped from the on-board water tank, the other end of the LDH supply hose is connected to the intake valve of a fire pump (generally a centrifugal pump) on the fire truck. Once the hydrant valve is turned "On" and the hose is charged with water and bled of residual air, the pump intake valve is opened, supplying positive pressure directly to the inlet of the pump, and the speed on the fire pump is reduced to prevent an increase in discharge pressure, and the tank outlet valve controlling the flow of water from the on-board water tank is closed so that the fire pump is supplied with water from the hydrant and then the water tank on the truck is refilled.

When the lay-flat hose is initially charged with water, residual air entrapped in the hose is often pushed ahead of the water as the lay flat hose contains some air even when flat in storage on the fire truck. The trapped air must be removed to avoid loss of pressure and flow problems caused by a water hammer or by cavitation in the water pump.

Typically, removal of the air from the hose is accomplished with a manually operated valve upstream of the intake valve on the pump which may lead to problems. An operator may forget to open the manually operated air bleed valve.

As an alternative to the conventional practice of manually flushing the hydrant, manually opening the hydrant valve and manually bleeding air from the LDH supply hose, an automatic fire hydrant flush valve, a remote-controlled hydrant supply valve and an automatic air bleed valve integrated with the pumper fire truck pump control system for flushing debris from the hydrant, opening the hydrant supply valve and venting air from the fire hose supplying water to the master intake valve and filling the on board water tank of a fire truck without operator intervention is highly desirable.

BRIEF SUMMARY OF THE INVENTION

Briefly stated, one embodiment of the present invention is directed to an automatic fire hydrant water supplying system for automatically providing hydrant supply water from a discharge port of a hydrant to a pumper fire truck. The pumper fire truck has a fire-truck water pump; a master intake valve having a master-intake-valve input port and a master-intake-valve discharge port, the master-intake-valve discharge port in fluid communication with the fire-truck water pump; a water-supply fire hose having a water-supply fire-hose input end and a water-supply fire-hose discharge end, the water-supply fire-hose discharge end in fluid communication with the master-intake-valve input port; a fire-truck water-pump control system operatively coupled to the master intake valve; and a pressure sensor in fluid communication with the water-supply fire hose upstream of the master-intake-valve input port and operatively coupled to the fire-truck water-pump control system.

The automatic fire hydrant water supplying system has a hydrant valve assembly having a remotely-controllable hydrant discharge valve having a hydrant-discharge-valve input port connectable to the discharge port of the hydrant and a hydrant-discharge-valve discharge port connectable to the water-supply fire-hose input end, the remotely-controllable hydrant discharge valve operatively coupled to and controlled by the fire-truck water-pump control system; and a remotely-controllable air bleed valve having an air-bleed-valve input port and an air-bleed-valve discharge port, the air-bleed-valve input port in fluid communication with the master-intake-valve input port and the fire-hose discharge port, the remotely-controllable air bleed valve operatively coupled to and controlled by the fire-truck water-pump control system. The fire-truck water-pump control system determines whether a pressurized volume in the fire hose upstream of the master-intake-valve input port is air or water based on a difference in density between air and water as sensed by the pressure sensor and if the pressurized volume is air causes the air to be vented to atmosphere through the air-bleed-valve discharge port before opening the master-intake-valve input port.

Another embodiment of the present invention is directed to a method for automatically bleeding air from a water-supply fire hose supplying hydrant water from a hydrant to a master intake valve of a pumper fire-truck water pump. The method comprising the steps of: connecting an input end of the water-supply fire hose to a discharge port of the hydrant and a discharge end of the water-supply fire hose to an input port of the master intake valve, the master-intake-valve discharge port being in fluid communication with the fire-truck water pump; providing a remotely-controllable air bleed valve having an air-bleed-valve input port and an air-bleed valve discharge port, the air-bleed-valve input port in fluid communication with the master-intake-valve input port and the fire-hose discharge port; sensing with a pressure sensor in fluid communication with the water-supply fire hose upstream of the master-intake-valve input port a density of a pressurized volume in the water-supply fire hose; determining with a fire-truck water-pump control system operatively coupled to the air bleed valve and the pressure sensor whether the pressurized volume in the water-supply fire hose upstream of the master-intake-valve input port is air or water based on a difference in density between air and water as sensed by the pressure sensor; and if the pressurized volume is determined to be air, under the control of the fire-truck water-pump control system venting the air to atmosphere through the air-bleed-valve discharge port and thereafter opening a master-intake-valve input port.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
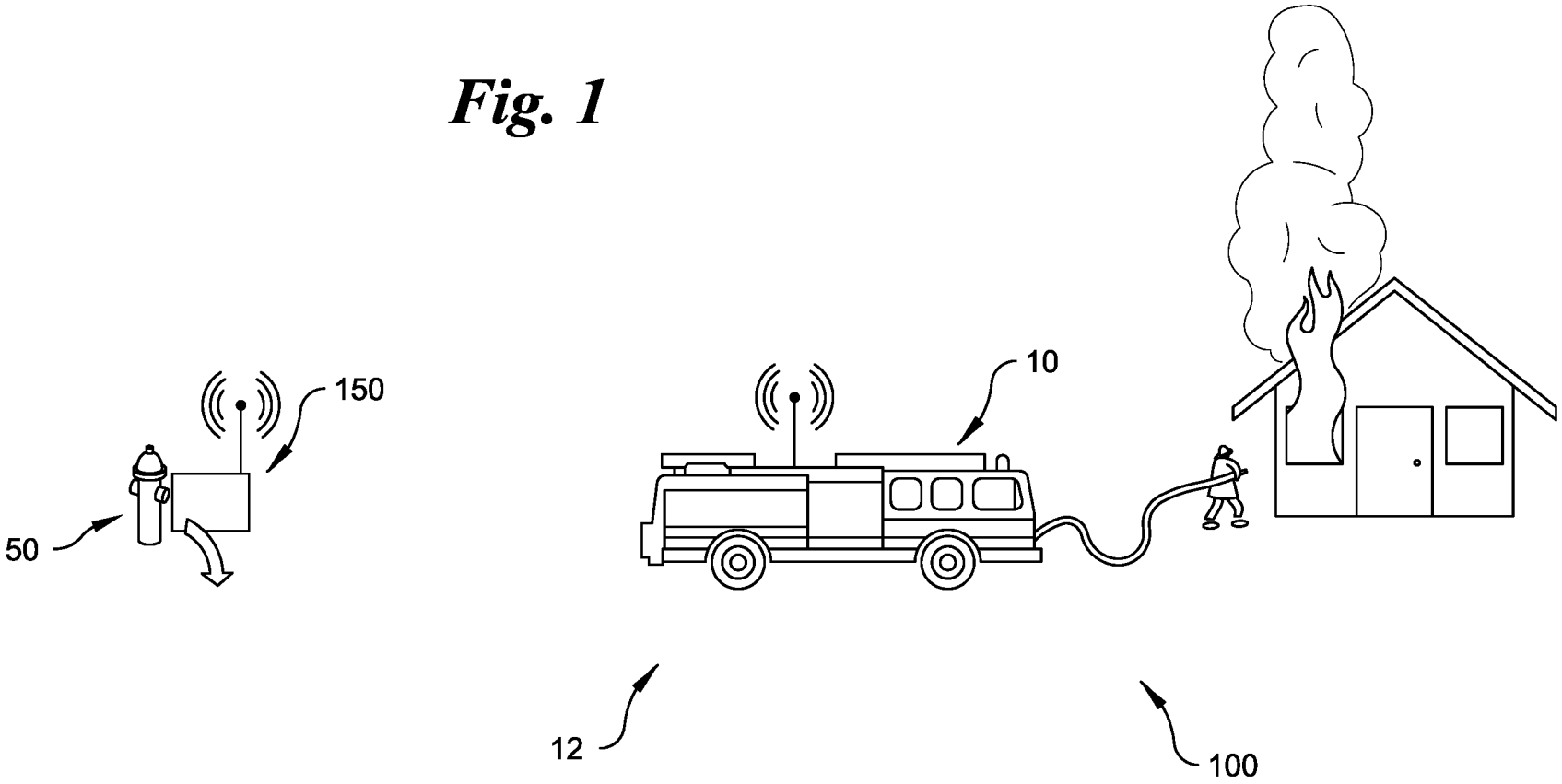
FIG. 1 is an artist's illustration of an embodiment of an automatic fire hydrant water supplying system in accordance with the present invention at a representative fire scene.

Reference will now be made in detail to embodiments of the invention, examples of which are illustrated in the accompanying drawings. The terminology used in the description of the invention herein is for the purpose of describing particular embodiments only and is not intended to be limiting of the invention.

As used in the description of the invention and the appended claims, the singular forms "a", "an" and "the" are intended to include the plural forms as well, unless the context clearly indicates otherwise. The words "and/or" as used herein refers to and encompasses any and all possible combinations of one or more of the associated listed items. The words "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The words "right," "left," "lower" and "upper" designate directions in the drawings to which reference is made. The words "inwardly" and "outwardly" refer to directions toward and away from, respectively, the geometric center of the automatic bleed valve assembly, and designated parts thereof. The terminology includes the words noted above, derivatives thereof and words of similar import.

As used herein, the words "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

The following description is directed towards various embodiments of an automatic air bleed valve assembly in accordance with the present invention.

Figure 2:
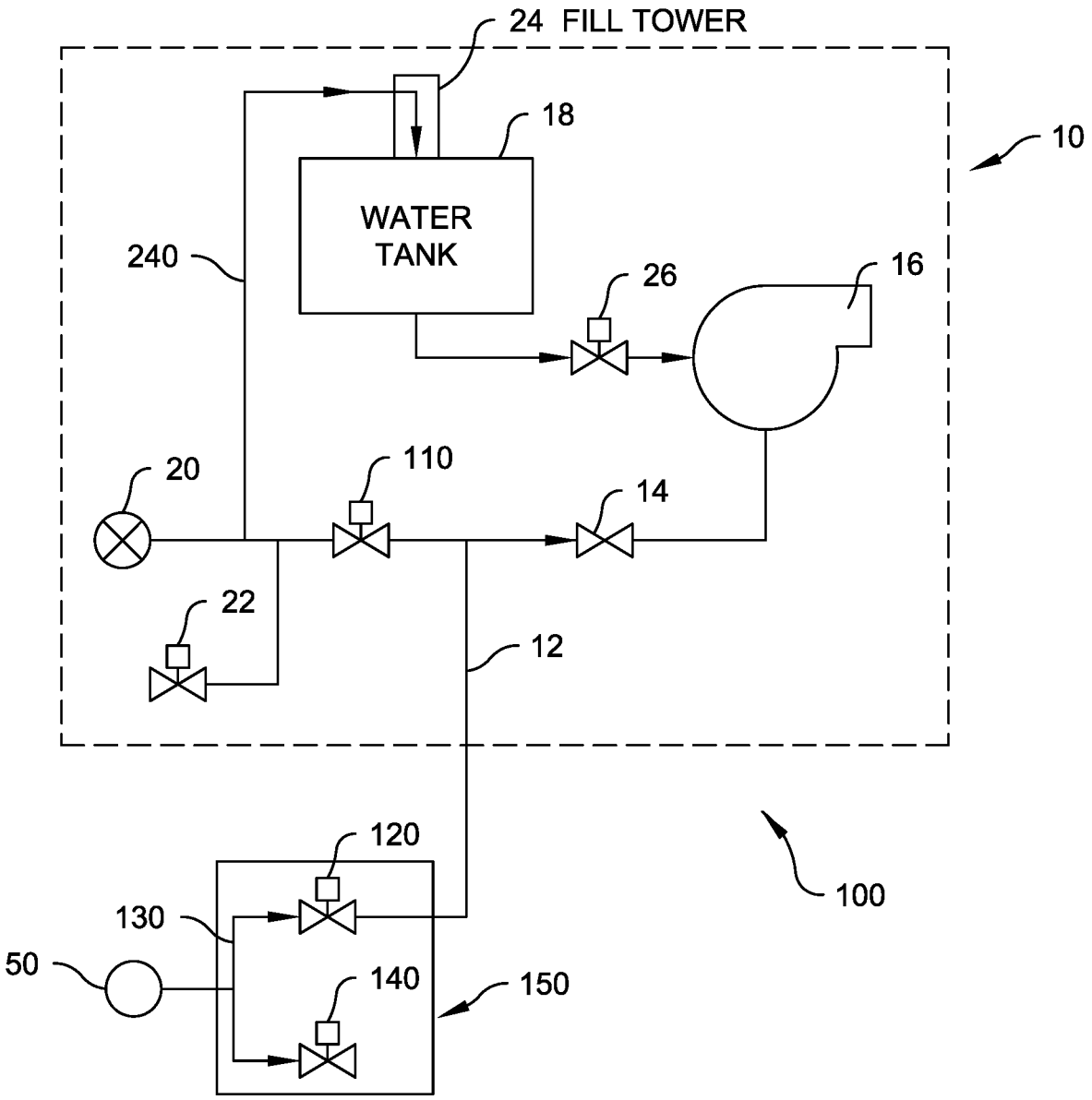
FIG. 2 is a schematic diagram of the automatic fire hydrant water supplying system of FIG. 1.
Figure 3A:
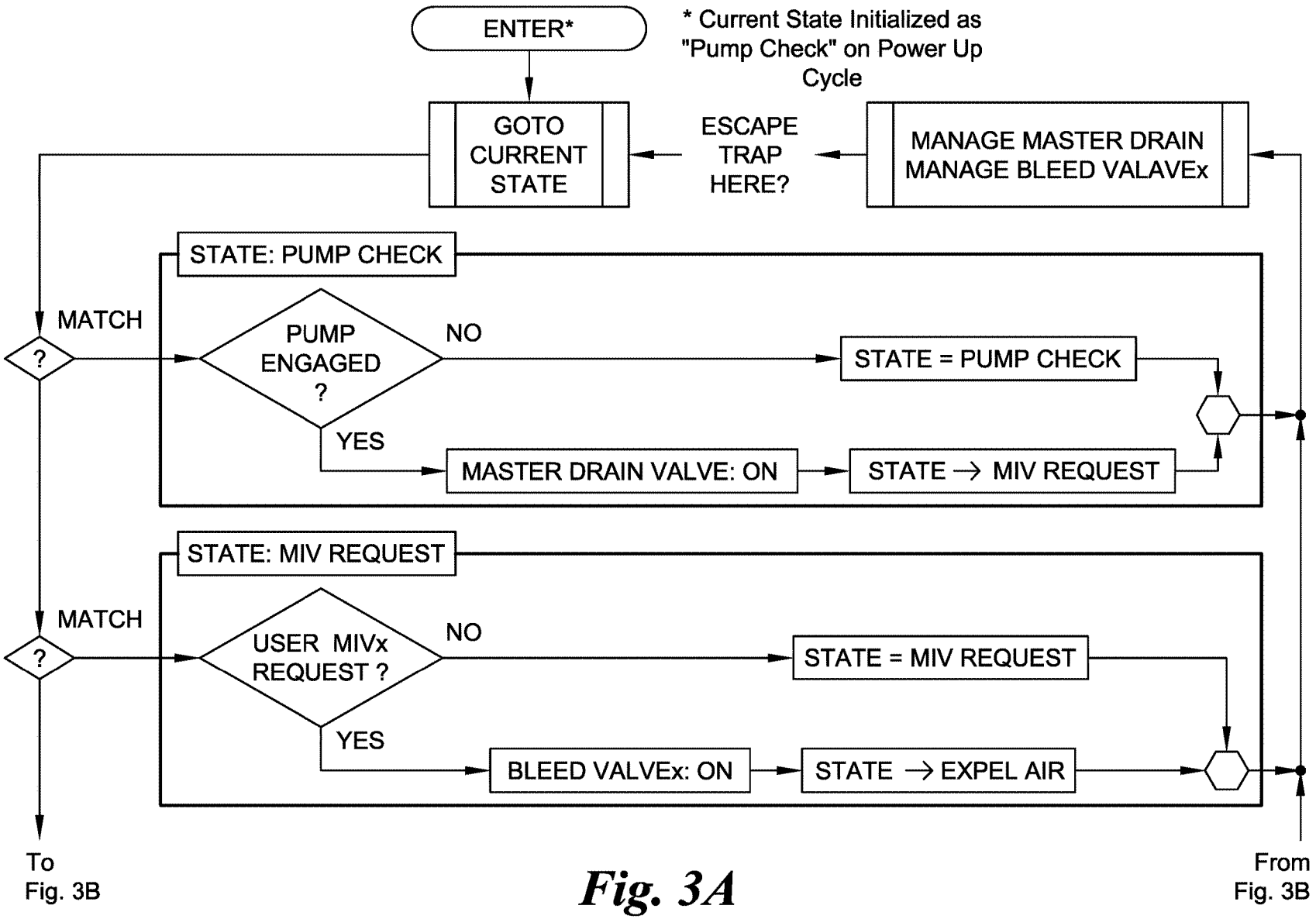
FIG. 3A-3D are logic flow diagrams showing the plurality of operational states for the automatic air bleed valve sub-assembly of FIG. 2.
Figure 3B:
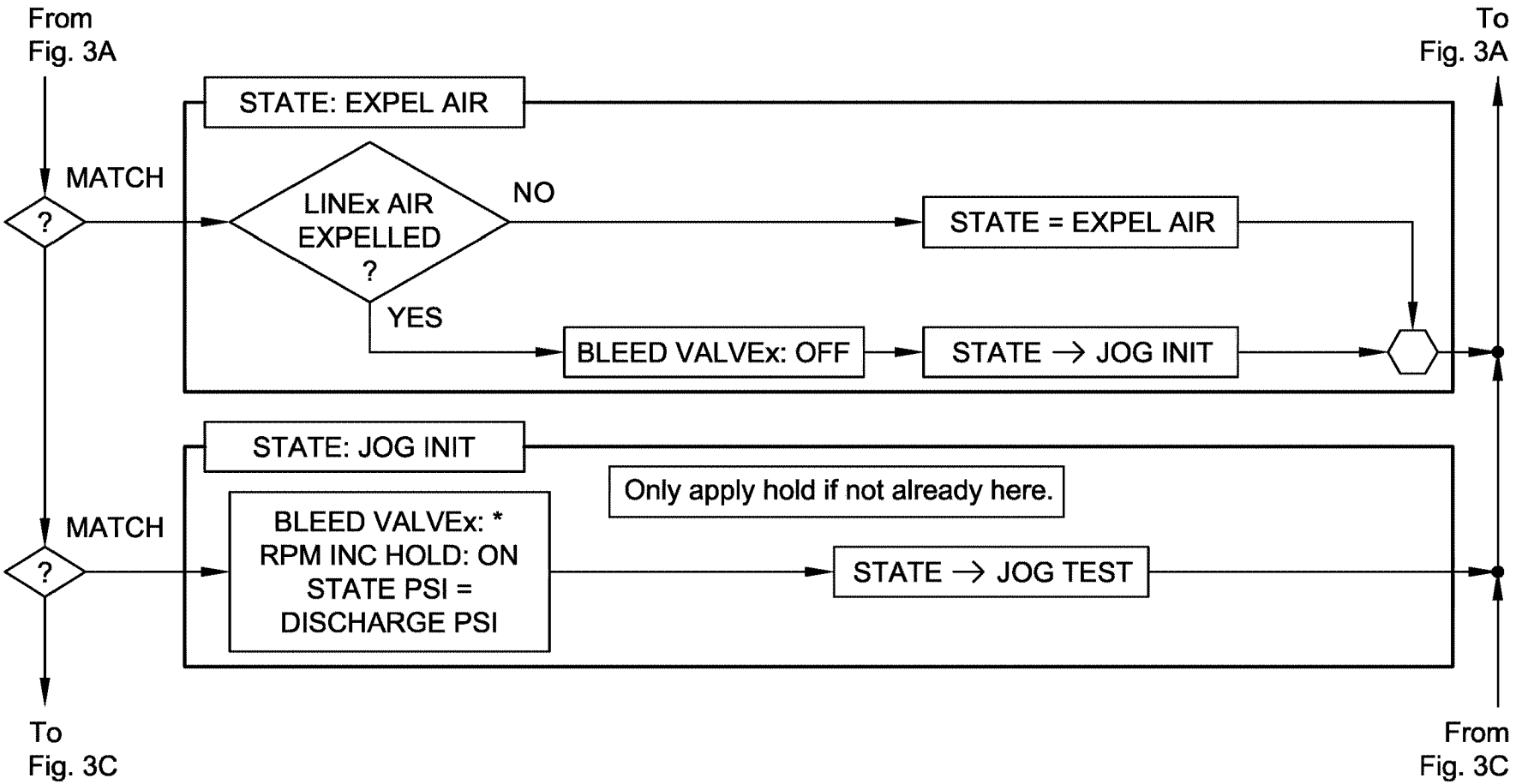
Figure 3C:
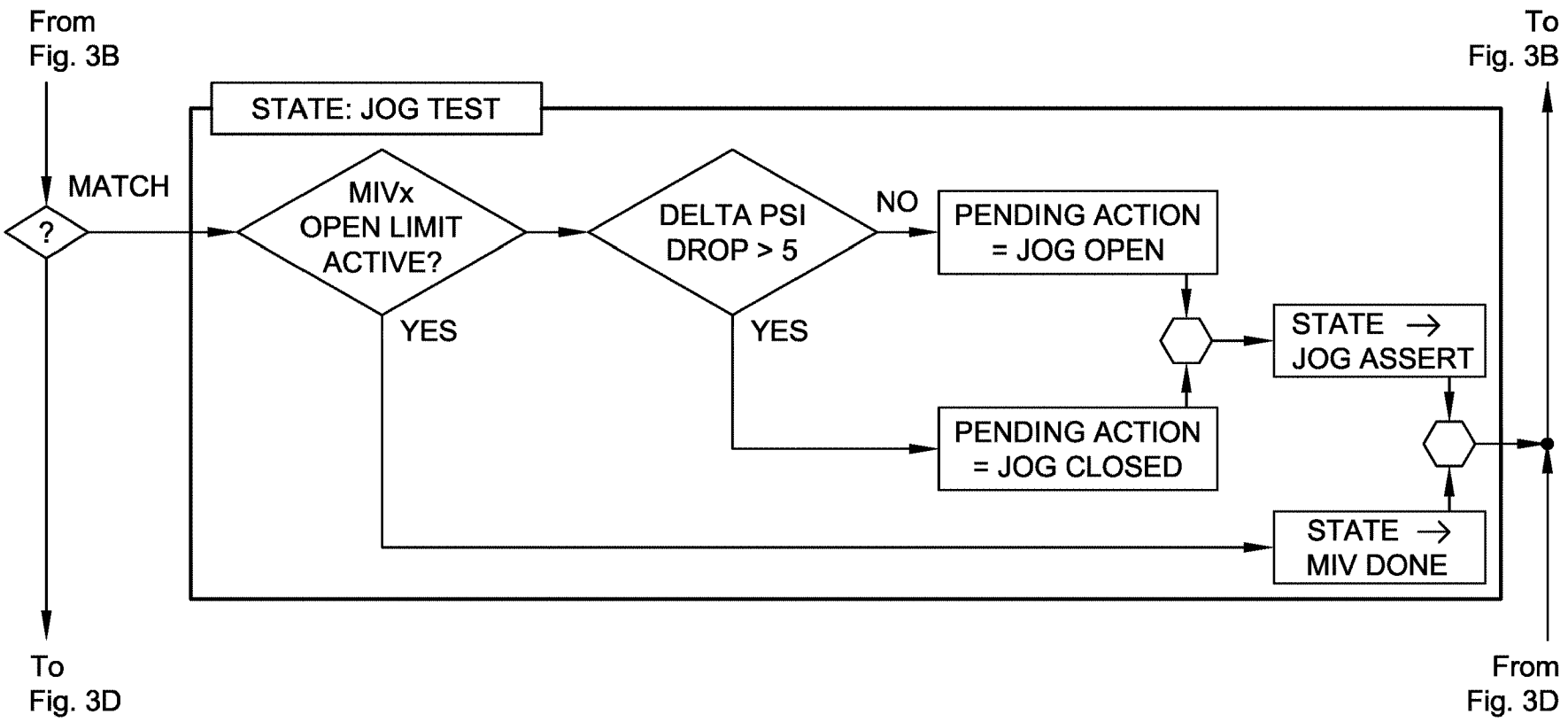
Figure 3D:
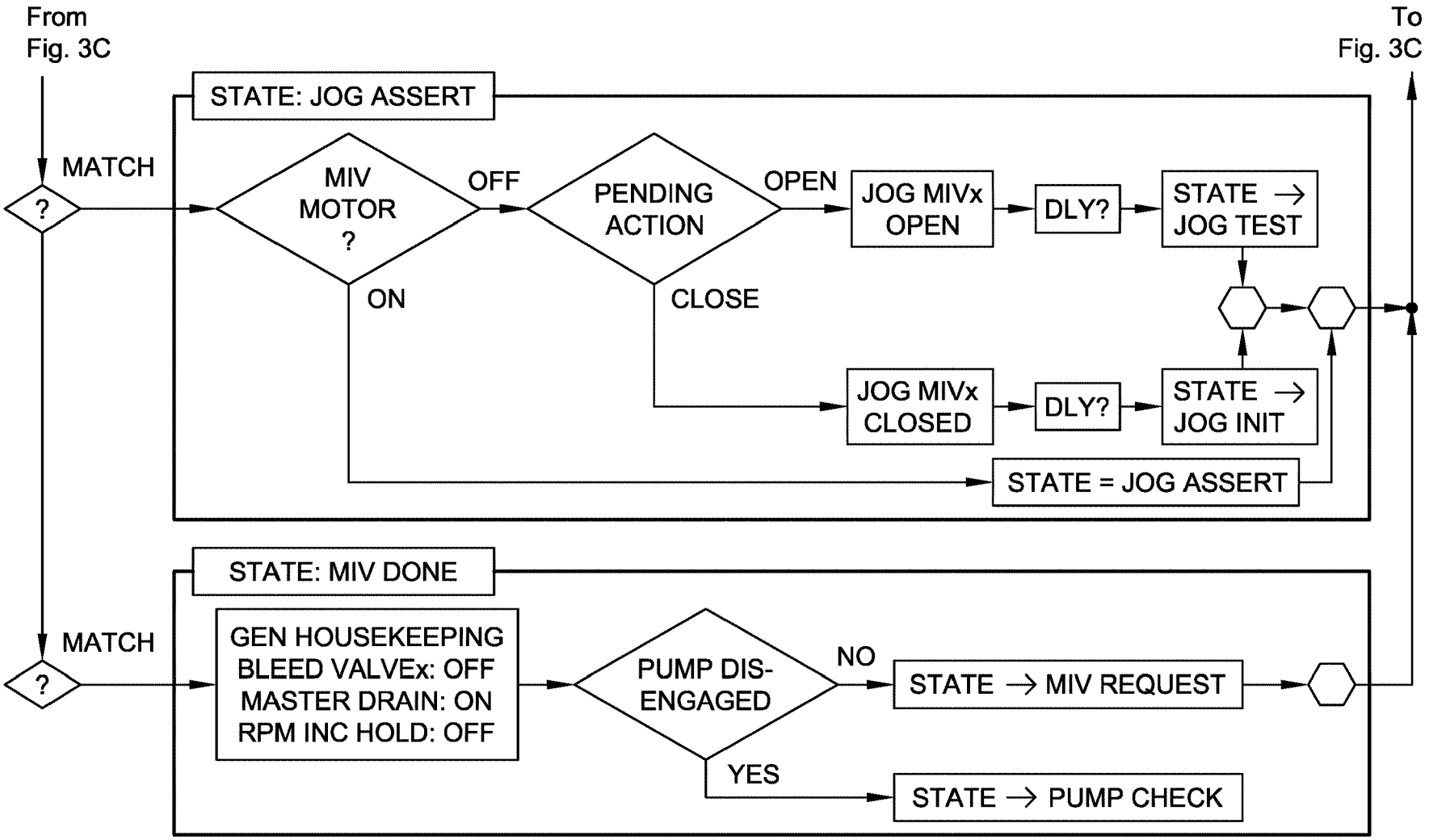
Figure 4:
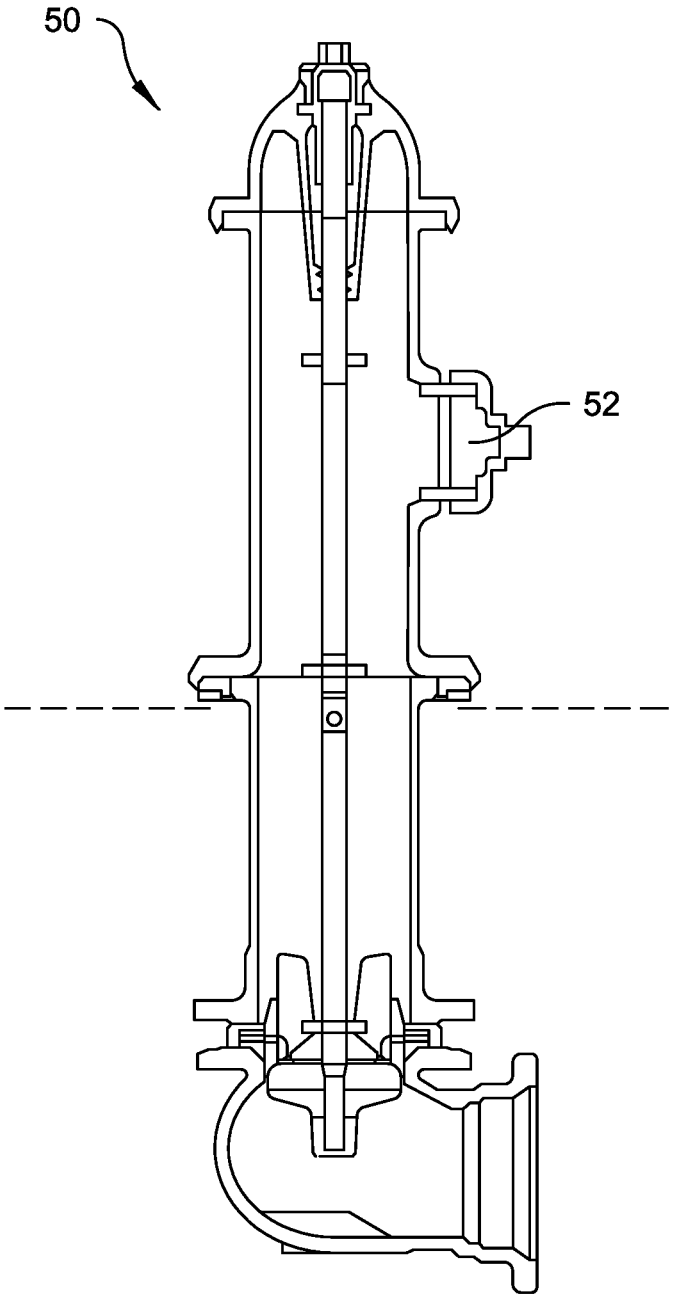
Fig. 4 (Prior Art)
FIG. 4 is an elevation view in cross section of a conventional prior art hydrant.
Figure 5:
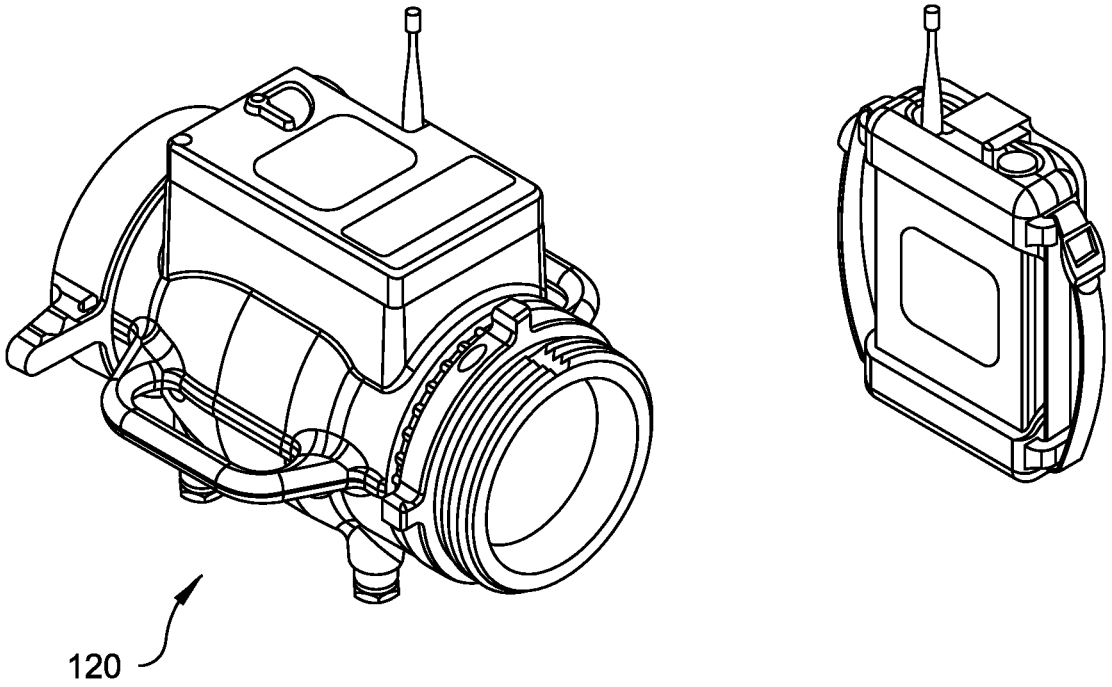
Fig. 5 (Prior Art)
FIG. 5 is graphic illustration of a prior art remote control hydrant discharge valve.

Referring to the drawings in detail, where like numerals indicate like elements throughout, there is shown in FIGS. 1-2 a first preferred embodiment of the automatic fire hydrant water supplying system, generally designated 100, and hereinafter referred to as the "hydrant water supplying system" 100 in accordance with the present invention. The hydrant water supplying system 100 is for automatically providing debris-free hydrant supply water to a pumper fire truck 10 and for venting to atmosphere air entrapped in the water supply hose 12 connecting a hydrant 50 to the master intake valve 14 of the fire truck water pump 16.

In a preferred embodiment the pumper fire truck 10 has a master intake valve 14 with a master-intake-valve input port and a master-intake-valve discharge port. The master-intake-valve discharge port is in fluid communication with the fire-truck water pump 16. A water-supply fire hose 12 has a water-supply fire-hose input end and a water-supply fire-hose discharge end. The water-supply fire-hose discharge end is in fluid communication with the master-intake-valve input port. A fire-truck water-pump control system 28 (See FIGS. 3A-3D) is operatively coupled to the master intake valve 14. A pressure sensor 20 is in fluid communication with the water-supply fire hose 12 upstream of the master-intake-valve input port and is operatively coupled to the fire-truck water-pump control system 28 through valve 110.

The pumper fire truck 10 has a water tank 18 with a water column 240 having a water column input port and a water column discharge port. The water column input port is in fluid communication with the air-bleed-valve 110 outlet port which is disposed below a bottom of the water tank 18. The water column discharge port is disposed at the top of the fill tower 24 that is immediately above the water tank 18 and is in fluid communication with a water-tank input port at a top of the water tank 18. The fire-truck water-pump control system 28 determines whether a pressurized volume in the fire hose 12 upstream of the master-intake-valve input port is air or water based on a difference in the weight between air and water in the water column 240 as sensed by the pressure sensor 20 and if the pressurized volume is air causes the air to be vented to atmosphere through the fill tower which is vented to atmosphere. The pressure sensor 20 in communication with the control system 28 determines the volume in the hose 12 is water before opening the master-intake-valve input port to allow water into the pump 16.

In a preferred embodiment of the automatic fire hydrant water supplying system 100, a hydrant valve assembly has a remotely-controllable hydrant discharge valve 120 with a hydrant-discharge-valve input port connectable to the discharge port of the hydrant 50 and a hydrant-discharge-valve discharge port connectable to the water-supply fire-hose input end. Further, the remotely-controllable hydrant discharge valve 120 is operatively coupled to and controlled by the fire-truck water-pump control system 28. In some embodiments, the hydrant valve assembly further comprises a remotely-controllable fire-hydrant flush valve 140 upstream of the hydrant-discharge-valve input port and in fluid communication with the output port of the hydrant 50. The remotely-controllable fire-hydrant flush valve 140 is operatively coupled to and controlled by the fire-truck water-pump control system 28. The fire-truck water-pump control system 28 causes the fire-hydrant flush valve 140 to discharge hydrant supply water to atmosphere for a predetermined time before opening the hydrant discharge valve 120.

A remotely-controllable air bleed valve 110 is provided and has an air-bleed-valve input port and an air-bleed-valve discharge port. The air-bleed-valve input port is in fluid communication with the master-intake-valve input port and the fire-hose discharge port. The remotely-controllable air bleed valve is operatively coupled to and controlled by the fire-truck water-pump control system.

The fire-truck water-pump control system 28 determines whether a pressurized volume in the fire hose 12 upstream of the master-intake-valve input port is air or water based on a difference in density between air and water as sensed by the pressure sensor 20 and if the pressurized volume is air causes the air to be vented to atmosphere through the air-bleed-valve discharge port before opening the master-intake-valve input port.

Preferably, the fire-truck water-pump control system 28 is operatively coupled to the remotely-controllable air bleed valve 110 and the remotely-controllable fire-hydrant flush valve 140 by a wireless communication link.

In conventional plumbing assemblies for pumper fire trucks 10, water supplied from a water source, such as a fire hydrant 50, fills a supply hose 12 (e.g., a large diameter lay flat hose, "LDH") and is forced to the truck. Air that is initially enclosed within the empty supply hose 12 is pushed ahead of the water and up to a master intake valve 14. If the master intake valve 14 is opened without "bleeding", or removing the air in front of the water, the pump 16 momentarily becomes "airbound" and, if so equipped, the engine controller operating in pressure control mode (governor) speeds up. Once the air is pushed past the impeller of the pump 16, the pressurized water from the hydrant 50 hits the impeller at elevated engine speeds and a dangerous pressure spike can occur. The pump operator can manually bleed the air from the supply hose of air which creates a delay and occupies the operator while they are waiting for the air to be bled from the supply hose.

Since a pumper fire truck 10 typically has a water tank 18 in the rear body section with a fill tower 24 or opening at the top of the vehicle (which adds to the effective vertical height), there exists a significant height difference (typically over 3-4 feet) between the inlet connection to the pump 16 where the LDH hose 12 is connected and the top of the water tank 18. The difference in the weight of water vs air is used in the hydrant water supplying system 100 as the basis for differentiating whether air or water is in the supply hose 12 leading to the intake of the fire truck pump 16.

Referring to FIGS. 1 and 2, as the hydrant 50 is opened and the typical LDH (lay flat) hose 12 is inflated with water, a mass of water moves towards the pump 16 and a mass of air trapped in front of the water is pushed to the pump inlet. This mass of air is air that is in the length of hose 12 and is compressed ahead of the water flowing from the hydrant 50. The pressure at the base of piping (water column 240) leading to the top of the water tank (above the water level) is essentially zero PSIG when air is bleeding thru the system and 2-3 psi based on the height of the water column when the air has been replaced by water. Fire trucks 10 already have tank level indicators that work off of the height of fluid in the tank above the pressure sensor 20. Whether water or air is in the supply hose 12 is determined by monitoring the pressure at the base of the piping (water column 240) leading to the water tank 18.

In practice, a drain valve 22 at the bottom of the water column is normally open so the column is dry. The drain valve 22 is closed when the LDH hose 12 is connected so the system always starts filled with air. A pressure increase at the bottom of the column when full of water is used as a signal to open the master intake valve 14 to supply water to the pump 16.

The hydrant water supplying system 100 has an automatic air bleed valve 110 for venting air from the fire hose 12 supplying water to the master intake valve 14 of the fire truck pump 14. The air bleed valve 110 is located upstream from the master intake valve 14 and is in fluid communication with the discharge end of the supply hose 14. A logic flow diagram showing the plurality of operational states for the automatic air bleed valve 110 operatively coupled to the master intake valve 14 and the fire truck pump control system is shown in FIGS. 3A-3D.

In addition to the air bleed valve 110, the hydrant water supplying system 100 comprises a remote-control hydrant discharge valve 120 connected to the output port 52 of a hydrant 50 by a hydrant manifold 130. The hydrant water supplying system 100, preferably but not necessarily, also comprises an automatic hydrant flush valve 140 connected to the hydrant 50 by the hydrant manifold 130. Although the hydrant discharge valve 120 and the hydrant flush valve 140 may be separate and distinct stand alone valves, preferably the hydrant discharge valve 120, the hydrant flush valve 140 and the hydrant manifold 130 are formed as an integrated hydrant valve assembly 150 having a hydrant valve assembly inlet port connectable to the output port 52 of the hydrant 50, a hydrant valve assembly flush port in fluid communication with the flush valve discharge port allowing the discharge of hydrant supply water directly to the environment (to flush debris out of the hydrant barrel) and a hydrant valve assembly outlet port connectable to one end of the LDH supply hose 12 and in fluid communication with the hydrant discharge valve discharge port.

The conventional method for manually providing hydrant water at a fire scene may be characterized by the sequence of operations is the following steps 1-12.

1. Pumper fire truck 10 pauses at the hydrant 50 and hydrant operator pulls the end of the LDH supply hose 12 and hydrant valve assembly 150 off the back of the truck.
2. Pumper fire truck 10 proceeds to fire building laying out LDH supply hose 12 as it goes.
3. Hydrant operator opens the hydrant 50 to flush debris out of the hydrant assembly 150 and then recloses the hydrant.
4. The hydrant operator then attaches the hydrant valve assembly 150 to the hydrant 50 and the hydrant operator must wait at the hydrant for the pump operator to connect the other end of supply hose 12.
5. When the pump operator is ready, the hydrant operator can open the hydrant and any valve so the supply hose 12 begins to become charged with water (and air).
6. Meanwhile, the pumper fire truck 10 has stopped at the building on fire.
7. The operator places fire truck pump 16 in gear.
8. The tank 18 to pump valve 26 is opened.
9. The operator typically begins flowing water from tank 18 to begin operations.
10. The operator attaches the supply hose 12 to the pumper fire truck 10 and presses a control button at the hose connection; the button lights up to indicate the system is ready to receive water from the hydrant by sending a signal to the hydrant operator.
11. Upon receipt of the signal, the hydrant operator, opens hydrant discharge valve 120 to supply water from hydrant 50 to LDH supply hose 12.

12. The pump operator at the pumper truck manually opens the air bleed valve 110 to bleed air from supply hose 12 and waits for water to be discharged indicating the hose is full of water.

13. Then the operator opens the master intake valve 14 supplying water to the fire truck water pump 16 and adjusts the engine speed or pump pressure.

14. Then the operator closes the tank to pump valve 26.

In lieu of the foregoing manual method, a preferred embodiment of a method for automatically providing hydrant supply water to a pumper fire truck and bleeding air from a water-supply fire hose 12 supplying hydrant water from a hydrant 50 to a master intake valve 14 of a pumper fire-truck water pump 16 in accordance with the present invention is set forth below.

1. The pumper fire truck 10 pauses at the hydrant 50 and the hydrant operator pulls the input end of the LDH supply hose 12 and the hydrant valve assembly 150 off the back of the truck.

2. The hydrant operator connects the input port of the hydrant valve assembly 150 to the discharge port 52 of the hydrant 50 and the discharge port of the hydrant valve assembly 150 to the input end of the water-supply fire hose 12 and opens the hydrant 50 and leaves it open. Hydrant operator is then free to walk to the fire scene and support other activities. The flush valve 140 automatically opens to flush debris from the hydrant to the ground and then automatically closes. The valve 120 that supplies water to the supply hose 12 remains closed at this time.

3. The pumper fire truck 10 proceeds to fire building laying out LDH supply hose 12 as it goes.

4. Upon arrival at the fire scene, the operator places fire truck pump 16 in gear.

5. The tank 18 to pump valve 26 is opened.

6. The operator typically begins flowing water from tank 18 to begin operations.

7. The operator connects the discharge end of the water-supply fire hose to an input port of the master intake valve.

8. The integrated pump control system sends a signal to hydrant valve assembly 150 that pumper fire truck 10 is ready for water.

9. The hydrant valve assembly 150 receives a signal from pumper fire truck 10 and opens hydrant discharge valve 120 to supply water from hydrant 50 to LDH supply hose 12.

10. Using a wireless link, the fire-truck water-pump control system opens the remotely-controlled hydrant flush valve and controls the flushing of hydrant water from the hydrant.

11. Upon completion of hydrant flushing, the fire-truck water-pump control system opens the remotely-controlled discharge valve and controls the discharge of hydrant water from the hydrant using a wireless link.

12. Sensing with a pressure sensor in fluid communication with the water-supply fire hose upstream of the master-intake-valve input port a density of a pressurized volume in the water-supply fire hose;

13. Determining with a fire-truck water-pump control system operatively coupled to the air bleed valve and the pressure sensor whether the pressurized volume in the water-supply fire hose upstream of the master-intake-valve input port is air or water based on a difference in density between air and water as sensed by the pressure sensor.

14. If the pressurized volume is determined to be air, under the control of the fire-truck water-pump control system the air is vented to atmosphere through the air-bleed-valve discharge port. The default position is assume it is air until the water pressure system decides it is water.

15. The fire-truck water-pump control system switches pump pressure governor (engine controller) mode to pressure with reduced limit on raising engine speed for safety.

16. The fire-truck water-pump control system opens the master-intake-valve input port slowly to allow pump pressure governor (engine controller) to react to control pressure and pauses if the discharge pressure drops a fixed amount to allow all air to be expelled from inlet hose 12.

17. Once master-intake-valve 14 is fully open the integrated pump control system drains the water column and is ready for an additional master-intake-valve 14 to be connected and proceed thru the same auto sequence since multiple master-intake-valve inlets may be installed on the same pumper fire truck.

18. The integrated pump control system closes the tank 18 to pump valve after the master-intake-valve 14 is fully open and suction pressure raised.

19. After operating from hydrant system fills water tank 18 to top.

The foregoing detailed description of the invention has been disclosed with reference to specific embodiments. However, the disclosure is not intended to be exhaustive or to limit the invention to the precise forms disclosed. Those skilled in the art will appreciate that changes could be made to the embodiments described above without departing from the broad inventive concept thereof. Therefore, the disclosure is intended to cover modifications within the spirit and scope of the present invention as defined by the appended claims.

I claim:

1. An automatic fire hydrant water supplying system automatically providing hydrant supply water from a discharge port of a hydrant to a pumper fire truck, the pumper fire truck comprising:

a fire-truck water pump;

a master intake valve having a master-intake-valve input port and a master-intake-valve discharge port, the master-intake-valve discharge port in fluid communication with the fire-truck water pump;

a water-supply fire hose having a water-supply fire-hose input end and a water-supply fire-hose discharge end, the water-supply fire-hose discharge end in fluid communication with the master-intake-valve input port;

a fire-truck water-pump control system operatively coupled to the master intake valve; and a pressure sensor in fluid communication with the water-supply fire hose upstream of the master-intake-valve input port and operatively coupled to the fire-truck water-pump control system, the automatic fire hydrant water supplying system comprising:

a hydrant valve assembly having a remotely-controllable hydrant discharge valve having a hydrant-discharge-valve input port connectable to the discharge port of the hydrant and a hydrant-discharge-valve discharge port connectable to the water-supply fire-hose input end, the remotely-controllable hydrant discharge valve operatively coupled to and controlled by the fire-truck water-pump control system; and a remotely-controllable air bleed valve having an air-bleed-valve input port and an air-bleed-valve discharge port, the air-bleed-valve input port in fluid communication with the master-intake-valve input port and the fire-hose discharge port, the remotely-controllable air bleed valve operatively coupled to and controlled by the fire-truck water-pump control system, wherein the fire-truck water-pump control system determines whether a pressurized volume in the fire hose upstream of the master-intake-valve input port is air or water based on a difference in density between air and water as sensed by the pressure sensor and if the pressurized volume is air causes the air to be vented to atmosphere through the air-bleed-valve discharge port before opening the master-intake-valve input port.

2. The automatic fire hydrant water supplying system according to claim 1, wherein the hydrant valve assembly further comprises a remotely/automatically-controllable fire-hydrant flush valve upstream of the hydrant-discharge-valve input port and in fluid communication with the output port of the hydrant, the remotely-controllable fire-hydrant flush valve operatively coupled to and controlled by the fire-truck water-pump control system, wherein the fire-truck water-pump control system causes the fire-hydrant flush valve to discharge hydrant supply water to atmosphere for a predetermined time before opening the hydrant discharge valve.

3. The automatic fire hydrant water supplying system according to claim 1, wherein the pumper fire truck has a water tank with a fill tower having a fill-tower input port and a fill-tower discharge port, the fill-tower input port in fluid communication with the air-bleed-valve outlet port which is disposed below a bottom of the water tank, the fill-tower discharge port disposed above the water tank and in fluid communication with a water-tank input port at a top of the water tank, wherein the fire-truck water-pump control system determines whether a pressurized volume in the fire hose upstream of the master-intake-valve input port is air or water based on a difference in the weight between air and water in the fill-tower as sensed by the pressure sensor and if the pressurized volume is air causes the air to be vented to atmosphere through the air-bleed-valve discharge port before opening the master-intake-valve input port.

4. The automatic fire hydrant water supplying system according to claim 1, wherein the fire-truck water-pump control system is operatively coupled to the remotely-controllable air bleed valve by a wireless communication link.

5. The automatic fire hydrant water supplying system according to claim 2, wherein the fire-truck water-pump control system is operatively coupled to the remotely-controllable air bleed valve and the remotely-controllable fire-hydrant flush valve the by a wireless communication link.

6. A method for automatically bleeding air from a water-supply fire hose supplying hydrant water from a hydrant to a master intake valve of a pumper fire-truck water pump comprising the steps of:

connecting an input end of the water-supply fire hose to a discharge port of the hydrant and a discharge end of the water-supply fire hose to an input port of the master intake valve, the a master-intake-valve discharge port being in fluid communication with the fire-truck water pump;

providing a remotely-controllable air bleed valve having an air-bleed-valve input port and an air-bleed valve discharge port, the air-bleed-valve input port in fluid communication with the master-intake-valve input port and the fire-hose discharge port;

sensing with a pressure sensor in fluid communication with the water-supply fire hose upstream of the master-intake-valve input port a density of a pressurized volume in the water-supply fire hose;

determining with a fire-truck water-pump control system operatively coupled to the air bleed valve and the pressure sensor whether the pressurized volume in the water-supply fire hose upstream of the master-intake-valve input port is air or water based on a difference in density between air and water as sensed by the pressure sensor; and if the pressurized volume is determined to be air, under the control of the fire-truck water-pump control system venting the air to atmosphere through the air-bleed-valve discharge port and thereafter opening a master-intake-valve input port.

7. The method for automatically bleeding air from a water-supply fire hose according to claim 6, further comprising:

connecting a remotely-controllable hydrant discharge valve to the hydrant, the hydrant discharge valve having a hydrant-discharge-valve input port in fluid communication with the discharge port of the hydrant and a hydrant-discharge-valve discharge port is in fluid communication with the water-supply fire-hose input end; and controlling a discharge of hydrant water from the hydrant with the fire-truck water-pump control system using a wireless link.

8. The method for automatically bleeding air from a water-supply fire hose according to claim 7, further comprising:

connecting a remotely-controllable fire-hydrant flush valve to the hydrant and the hydrant discharge valve, the fire-hydrant flush valve having a fire-hydrant flush valve inlet port in fluid communication with the hydrant discharge port and the hydrant-discharge-valve input port, and a fire-hydrant flush valve discharge port in fluid communication with atmosphere;

controlling a flushing of hydrant water from the hydrant with the fire-truck water-pump control system using a wireless link.

* * * * *